United States Patent [19]

Franz et al.

[11] 4,392,405

[45] Jul. 12, 1983

[54] METHOD AND APPARATUS FOR PROCESSING TONE SIGNALS IN ELECTRONIC MUSICAL INSTRUMENTS

[75] Inventors: Reinhard Franz, Tulpenstrasse 15, D-5401 Emmelshausen, Fed. Rep. of Germany; Wilfried Dittmar, Halsenbach, Fed. Rep. of Germany

[73] Assignee: Reinhard Franz, Emmelshausen, Fed. Rep. of Germany

[21] Appl. No.: 235,960

[22] Filed: Feb. 19, 1981

[30] Foreign Application Priority Data

Feb. 21, 1980 [DE] Fed. Rep. of Germany ..... 3006495

[51] Int. Cl.[3] ..... G10H 1/02

[52] U.S. Cl. ..... 84/1.24; 179/1 J; 84/DIG. 4; 84/DIG. 26

[58] Field of Search ..... 328/155, 55; 179/1 J; 307/262; 364/724; 84/1.24, 1.03, DIG. 4, DIG. 26

[56] References Cited

U.S. PATENT DOCUMENTS

| | | | |
|---|---|---|---|
| 3,947,638 | 3/1976 | Blankinship | 328/55 |
| 4,121,058 | 10/1978 | Jusko et al. | 179/1 J |
| 4,125,900 | 11/1978 | Betts | 364/724 |
| 4,275,267 | 6/1981 | Kurtin et al. | 179/1 J |

*Primary Examiner*—J. V. Truhe
*Assistant Examiner*—Forester W. Isen
*Attorney, Agent, or Firm*—Kontler, Grimes & Battersby

[57] ABSTRACT

Tone amplitudes of signals which are generated in an electronic organ are converted into digital values and such values are cyclically memorized by a RAM storage at locations which are selected in accordance with a first function. The locations in the storage are then scanned in accordance with one or more second functions which differ from the first function in dependency on time, the thus ascertained or read-out digital values are thereupon converted into analog values, and the analog values are consolidated into processed tone signals. The second functions are or can be derived from the first function.

16 Claims, 3 Drawing Figures

METHOD AND APPARATUS FOR PROCESSING TONE SIGNALS IN ELECTRONIC MUSICAL INSTRUMENTS

BACKGROUND OF THE INVENTION

The present invention relates to electronic musical instruments in general, and more particularly to improvements in a method and apparatus or system for processing tone signals in electronic pianos, electronic organs or analogous key-operated electronic musical instruments. Still more particularly, the invention relates to a method and system for processing tone signals which are transmitted with a variable delay in an electronic organ or an analogous electronic musical instrument.

A conventional system of the above outlined character is disclosed in German Offenlegungsschrift No. 26 07 136. The tone signal is applied to the input of an analog shift register with periodically varying pulse frequency. To this end, the system employs a voltage-regulated oscillator which is operated with a sinusoidal control potential of 0.6 Hz. This furnishes a phase shift vibrato. By connecting several analog shift registers in parallel in such a way that their pulse frequencies depend from the same control voltages which are out of phase, one can obtain a string or orchestra effect. This effect can be improved if a sinusoidal auxiliary potential of lower amplitude but higher frequency is superimposed upon the control voltage. If the amplitudes of sinusoidal control voltages are different, one can achieve a vibrato effect of highly complex tonality. If the processed tone signal is fed back to the input of the shift register, one can achieve natural frequencies which impart to the tone a celeste vibrato or fading effect.

A drawback of the just described conventional tone processing system is that the interval of delay cannot be reduced at will, i.e., the minimal delay corresponds to that interval which is needed to transport a signal from the input to the output of the analog shift register at a maximum pulse frequency. Moreover, two or more parallel delay paths can be achieved only by resorting to an equal number of discrete shift registers; this contributes to complexity, bulk and cost of the conventional system.

OBJECTS AND SUMMARY OF THE INVENTION

An object of the invention is to provide a novel and improved method of producing complex or highly complex processed tone signals with a delay which is a fraction of heretofore achievable delays.

Another object of the invention is to provide a novel and improved method of converting unprocessed tone signals into highly complex processed tone signals by resorting to a simple and inexpensive apparatus.

A further object of the invention is to provide a method of producing processed tone signals which are transmitted with a variable delay and create celeste, celeste vibrato, fading and/or other complex effects.

An additional object of the invention is to provide a novel and improved apparatus for the practice of the above outlined method.

Another object of the invention is to provide an apparatus which can complete the conversion of unprocessed tone signals into processed tone signals within a fraction of the time that is needed in the aforediscussed conventional system.

A further object of the invention is to provide an apparatus of the above outlined character which can be used with advantage in electronic organs.

An ancillary object of the invention is to provide novel and improved means for varying the mode of processing unprocessed tone signals in an electronic organ or an analogous electronic musical instrument.

One feature of the invention resides in the provision of a method of processing tone signals which are transmitted with a variable delay, especially for processing tone signals in an electronic organ or an analogous electronic musical instrument. The method comprises the steps of converting the amplitude of an unprocessed tone signal into digital values, cyclically memorizing such digital values at locations which are selected in accordance with a first function, cyclically scanning the locations in accordance with at least one second function which differs from the first function in dependency on time, converting the thus ascertained or detected digital values into analog values, and consolidating the analog values into a processed tone signal.

The second function is preferably derived from the first function, e.g., by subtracting a variable differential function from the first function. The method then preferably further comprises the step of periodically varying the differential function.

If the scanning step includes scanning the locations in accordance with a plurality of second functions each of which differs from the first function, the second functions are preferably derived from the first function by subtracting from the first function a different periodically varying differential function for each of the second functions. The just mentioned differential functions can have identical frequencies but different phase relationships.

Each of the cycles preferably includes a memorizing step and at least one scanning step following the memorizing step. Preferably, each cycle embraces at least two and most preferably more than two scanning steps.

Another feature of the invention resides in the provision of an apparatus for the practice of the above outlined method. The apparatus comprises means for supplying unprocessed tone signals, a memory having a plurality (e.g., 512) of storing locations, first transducer means (e.g., a conventional analog-digital converter) for converting the amplitude of each supplied unprocessed tone signal into digital values and for transmitting such values to the memory, addressing means for effecting cyclical memorizing of such digital values at locations which are selected in accordance with the first function, means for scanning the locations of the memory in accordance with at least one second function which differs from the first function in dependency on time, and second transducer means (e.g., a commercially available digital-analog converter circuit) for converting the thus ascertained or read-out digital values into analog values and for consolidating such analog values into processed tone signals. The input and output means of the memory are respectively connected with the first and second transducer means. The addressing means preferably comprises means for repeatedly counting to n (wherein n is the number of storing locations) and includes means for generating the first function. The scanning means comprises means for generating the second function or functions and preferably includes means for deriving such second function or functions from the first function.

The novel features which are considered as characteristic of the invention are set forth in particular in the appended claims. The improved musical instrument itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
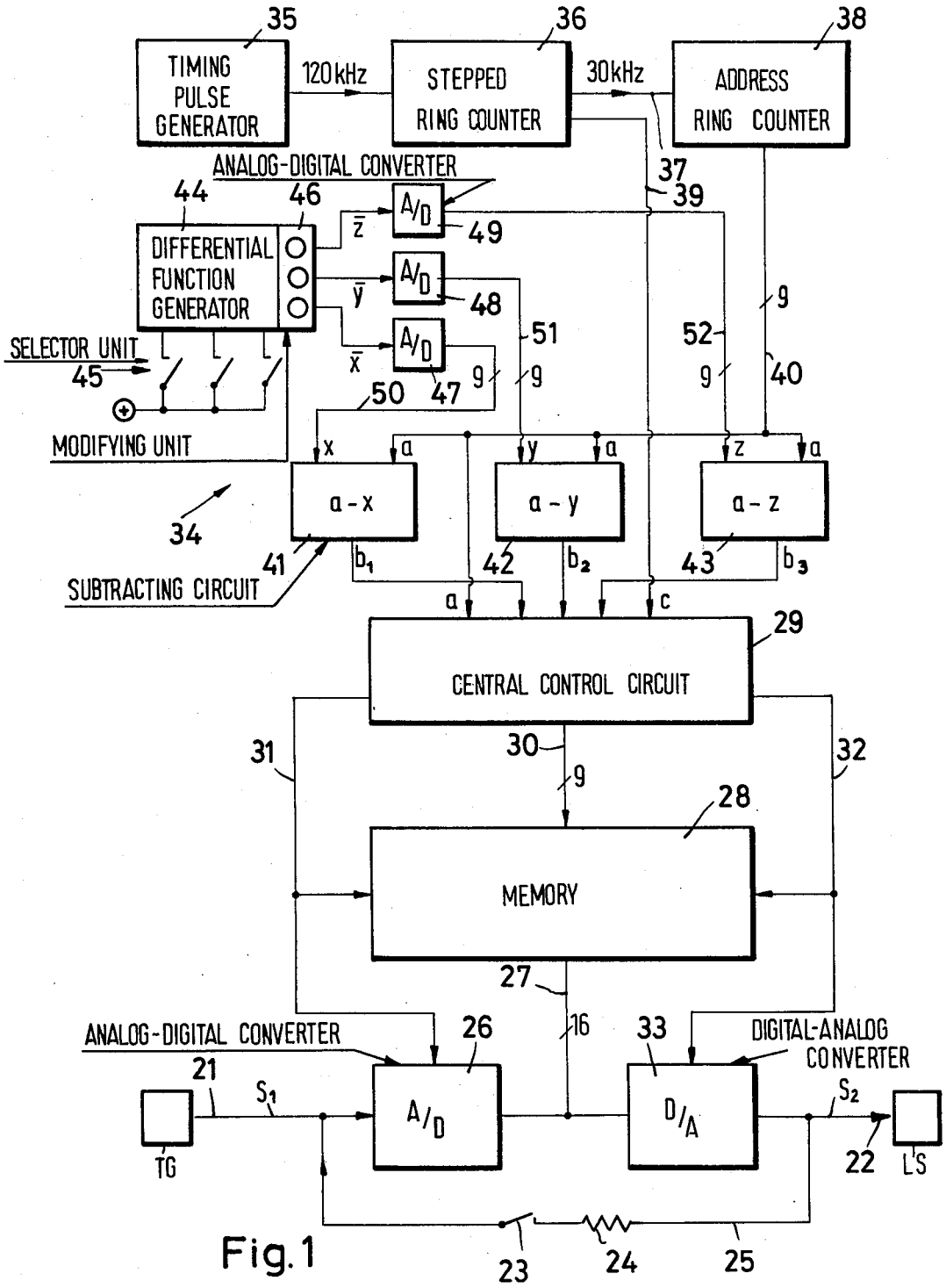
FIG. 1 is a block diagram of an apparatus which forms part of an electronic organ and embodies one form of the invention.

Referring first to FIG. 1, there is shown a conduit 21 which supplies unprocessed tone signals $S_1$ from the tone generator system TG of an electronic organ or an analogous electronic musical instrument. The reference character 22 denotes a conduit which transmits processed tone signals $S_2$ to a loudspeaker LS or another suitable tone reproducing device. A feedback connection 25 between the conduits 22 and 21 contains a switch 23 and a resistor 24; its function is to apply processed signals $S_2$ to the left-hand input of a first transducer 26 which constitutes an analog-digital converter circuit and whose output transmits signals to a 16-channel data transmitting conductor 27 connected to an input of a working memory 28. The purpose of the circuit 26 is to convert the amplitude of tone signals $S_1$ into digital values and to transmit such digital values cyclically to the corresponding input of the memory 28. The memory 28 is an RAM storage with a total of 512 16-bit storing locations. In many instances, it suffices to process the amplitude values of a tone signal $S_1$ in the form of 12-bit or 8-bit signals. A main or central control circuit 29 is connected with the memory 28 by a read-in control conduit 31, a 9-channel addressing conduit 30 and a readout signal conductor 32. A signal via conductor 31 is followed by a signal via conductor 32; at the same time, the conductor 30 transmits a fresh signal for selection of a different address. The digital information which is selected by the signals supplied via conductor 32 is conveyed to a second transducer 33 via conductor 27; the transducer 33 is a digital-analog converter circuit whose output is connected with the conductor 22 and hence also with the input of the transducer 26. The transducer 33 consolidates the digital signals which are supplied via conductor 27 into a processed tone signal $S_2$.

A cycle is completed after the conductor 32 transmits three readout signals, each for a different address. A fresh cycle begins upon completion of the preceding cycle.

The apparatus of FIG. 1 further comprises an addressing circuit 34 with a timing pulse generator 35 having a frequency of, for example, 120 kHz. The timing pulses supplied by the generator 35 activate a stepped ring counter 36 which completes four steps during each cycle and, upon completion of a cycle, transmits an advancing signal via first output 37 to an address ring counter 38. A second output 39 of the ring counter 36 transmits counting signals c to the main control circuit 29. The counting signals a of the second ring counter 38 form the first addressing function. The signals a from the ring counter 38 are transmitted, via 9-channel conductor means 40, directly to the control circuit 29 as well as to the first inputs of three subtracting circuits 41, 42 and 43. The second inputs of the subtracting circuits 41, 42 and 43 respectively receive signals denoting differential functions x, y and z so that the outputs of these subtracting circuits respectively transmit signals $b_1$, $b_2$ and $b_3$ which constitute the second addressing functions and are transmitted to the main control circuit 29. The address ring counter 38 has a counting cycle n wherein n is the number of storing locations (namely, 512) in the memory 28.

The central control circuit 29 comprises means for linking the function signals a, $b_1$, $b_2$, $b_3$ and c in such a way that, when the count of the first ring counter 36 equals one, the circuit 29 transmits a read-in signal via conductor 31 and the address a is transmitted to the memory 28. When the count of the counter 36 equals two, the control circuit 29 transmits a readout signal via conductor 32 and the address $b_1$ is transmitted to the memory 28. At the count three by the ring counter 36, the circuit 29 again transmits a readout signal via conductor 32 and the address $b_2$ is transmitted to the memory 28. Finally, when the count of the ring counter 36 equals four, the conductor 32 transmits a readout signal and the address $b_3$ is transmitted to the memory 28.

The three differential functions x, y and z are generated by an analog differential function generator 44. To this end, the function generator 44 comprises suitable oscillator means, blocking oscillators or like conventional components. A selector unit 45 is provided to allow for selection of a desired differential function. The apparatus of FIG. 1 further comprises a modifying unit 46 which is capable of varying the amplitude and/or frequency of each of the three differential functions x, y z. The thus obtained analog differential functions $\bar{x}$, $\bar{y}$ and $\bar{z}$ are respectively transmitted to analog-digital converter circuits 47, 48 and 49 which respectively comprise 9-channel output connections 50, 51 and 52 for transmittal of the digital differential functions x, y and z to the subtracting circuits 41, 42 and 43, respectively.

The linking between the stepwise generated signals of the ring counter 36 and the addresses of the first and second functions can take place outside of the main control circuit 29, for example, by resort to AND gates having first inputs for signals from the ring counter 36 and second inputs for signals denoting the addresses of the first and second functions. This modification is not specifically shown in the drawing.

Figure 3:
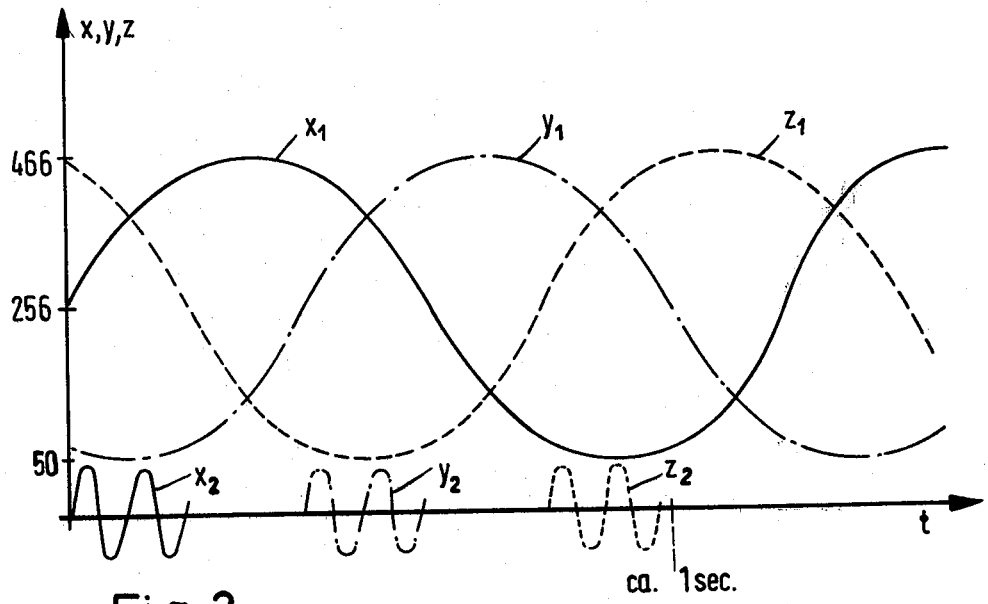
FIG. 3 is a diagram illustrating various differential functions.

FIG. 3 illustrates one embodiment of the differential functions in a coordinate system wherein time t is measured along the abscissa and the amplitude is measured along the ordinate. The differential function x is obtained by superimposition of the sinusoidal curves $x_1$ and $x_2$. The amplitude of the curve $x_2$ is lower but the frequency of this curve is higher than that of the curve $x_1$. The differential function y is obtained by superimposition of sinusoidal curves $y_1$ and $y_2$, and the differential function z is obtained as a result of superimposition of curves $z_1$ and $z_2$. After digital conversion, the sinusoidal curves $x_1$, $y_1$ and $z_1$ pass through the values from 50 to 466, and the sinusoidal curves $x_2$, $y_2$ and $z_2$ through the values between minus 49 and plus 49. Thus, when considered in their entirety, the differential functions are within the supply of 512 storing addresses. They can be reduced in size by resort to the aforementioned modifying unit 46 of FIG. 1. The subtracting circuits 41, 42 and 43 also operate cyclically, i.e., the sum of a negative result is subtracted from 512.

During each cycle, the operation of the apparatus of FIG. 1 is as follows:

During the first stage, information is transmitted from the analog-digital converter 26 into the memory 28 in accordance with the first function a. The next step involves the readout of the contents of the memory 28 with the address a-x (function $b_1$), the third step involves a readout with the address a-y (function $b_2$), and the fourth step a readout with the address a-z (function $b_3$). The address a passes cyclically through the values 1 to 512. The addresses $b_1$, $b_2$ and $b_3$ distinguish from the address a by the respective differential functions x, y and z, i.e., their values are quite different but such functions are linked or related to each other by substantially continuous functions. During each cycle, information is withdrawn practically simultaneously from three addresses, namely, from three addresses which were stored at widely different times so that the information which is withdrawn has been delayed for widely different intervals of time. This entails the formation of a highly desirable and highly complex processed tone signal $S_2$.

Figure 2:
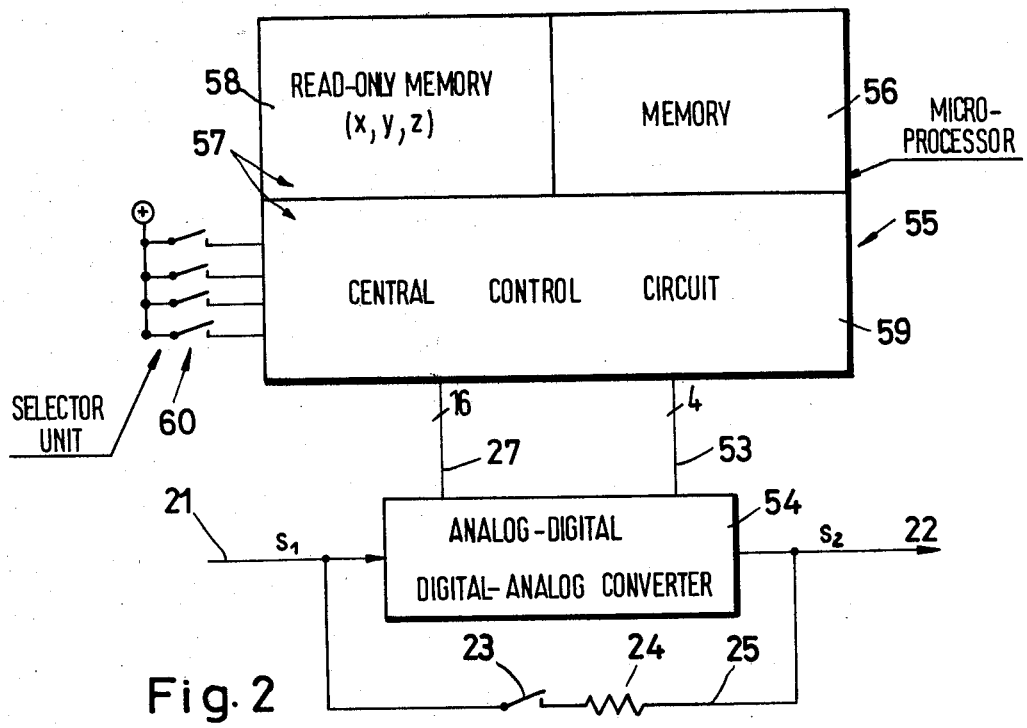
FIG. 2 is a block diagram of a second apparatus.

FIG. 2 illustrates certain components of a modified apparatus wherein the transducers 26 and 33 of FIG. 1 are combined into a single analog-digital converter circuit 54 having an input connected with the conductor 21 for admission of unprocessed tone signals $S_1$, an output connected to the conductor 22 for transmission of processed tone signals $S_2$ and a further input connected with a microprocessor 55 by a 4-channel control conductor 53. The converter circuit 54 can act as an analog-digital transducer or as a digital-analog transducer, depending on the nature of signals transmitted via control conductor 53.

The microprocessor 55 comprises an RAM working memory 56 which has a requisite number of storing locations for digital values representing the amplitude of an unprocessed tone signal $S_1$. The microprocessor 55 further comprises an addressing circuit 57 having a read-only memory 58 and a control circuit 59 connected to the circuit 54 by a 16-channel conductor 27. The memory 58 is an ROM storage for several differential functions (x, y, z) in digital form. Any given function can be selected on actuation of the corresponding switch in a selector unit 60. If one and the same differential function is utilized several times, it suffices to store such function only once in the memory 58; the request for such function at a desired time takes place by appropriate addressing. The unit 60 also permits for a change in the program in such a way that a desired differential function is established by selection from a given number of digital values with resort to appropriate addressing.

The mode of operation of the apparatus of FIG. 2 is analogous to that of the apparatus which is shown in FIG. 1. The addresses a are determined by counting, and the required counting operation is performed in the microcomputer 55, namely, in the control circuit 59. The formation of differences for the second addressing functions $b_1$, $b_2$ and $b_3$ is also carried out in the microcomputer.

The components of the apparatus shown in FIGS. 1 and 2 are standard integrated circuits which are available on the market. Therefore, the details of such components are not shown in the drawing.

An important advantage of the improved method and apparatus is that one can greatly reduce the minimal delay. In an extreme case, the delay can be reduced to the duration of a single timing pulse. If the number of storing locations equals n, the maximum delay equals $n-1$ times the interval of a single timing pulse. This renders it possible to operate with highly pronounced variations of the intervals of delay and to achieve corresponding highly characteristic effects. If the processed tone signals $S_2$ are fed back, and if the interval of delay is relatively short, one and the same tone signal can be processed several times. This leads to much higher resonance frequencies than in heretofore known systems. If the tone signal is to be processed parallel with several different delays, the outlay for the apparatus need not be increased at all; all that is necessary is to address the stored locations in accordance with two or more second functions. Therefore, it presents no problems to undertake three or more parallel processing operations in order to further enhance the liveliness of the processed tone signal.

As described above, the second function or functions can be derived from the first function by subtracting from the latter variable differential functions. This ensures that one can achieve any desired progress of delays irrespective of the progress of the first function. Periodic variations of the variable differential function or functions are especially advantageous and desirable. Several second functions are resorted to if one desires to achieve more complex tonal effects. As described in connection with FIG. 1, each second function can be obtained by subtracting a different differential function from the first function. All differential functions may have the same frequency but different phase relationships.

The operation is especially simple if each cycle includes a memorizing step and at least one scanning step which follows the memorizing step. The developing interruptions of the processed tone signal cannot be discerned by human ears; furthermore, the pauses are smoothed out by the inductances in the apparatus.

The addressing circuit 34 generates the addresses of the first function by repeated counting to n and its differential function generator 44 furnishes varying numbers which are utilized for the generation of addresses of the second function by deducting such numbers from the numbers denoting the first function. It will be noted that the memory is cyclically filled with digital amplitude values and each next-following read-in of digital amplitude values preferably entails eradication of the previously stored information at the same storing location. The counting operation constitutes an especially simple possibility of generating the address of the first function. Furthermore, the subtraction of differential functions also constitutes a relatively simple procedure, especially if the generation of addresses takes place with resort to binary signals.

An advantage of the apparatus of FIG. 1 is that the analog-digital converter circuits 47–49 of the addressing means 34 follow the modifying unit 46. This renders it possible to adequately influence the differential functions prior to conversion into digital functions x, y and z. On the other hand, the provision of a read-only memory, such as the memory 58 in the microprocessor 55 of FIG. 2, brings about the advantage that there is no need to constantly form the differential functions. Thus, all that is necessary is to form the differential function once and to store the thus obtained differential function in the memory 58. As explained above, this applies even if one and the same differential function is utilized more than once at different times since the memory 58 can be addressed to furnish the desired differential function in a relatively simple way.

The modifying unit 46 can be designed to convert the differential function generator 44 for the generation of triangular curves instead of sinusoidal curves in order to achieve additional desirable tonal effects. Moreover, and as explained above, the unit 46 can be used to modify the amplitude and/or frequency of the differential functions, again for the purpose of modifying the tonal effects, especially of producing more pronounced tonal effects.

The combination of the ring counter 38 and subtracting circuits 41, 42 and 43 contributes to simplicity of the apparatus which is shown in FIG. 1, i.e., to simplicity of the addressing circuit 34. The counting cycle of the stepped ring counter 36 equals the sum of the first and second functions, and this ring counter transmits a signal to the counter 38 upon completion of each counting cycle. Furthermore, the signals from the ring counter 36 initiate the application of the first function as well as of at least one second function. Thus, one and the same timing pulse generator 35 suffices to subdivide each pulse into several parts which can be used for read-in and read-out of information from different addresses. The microprocessor 55 of FIG. 2 contributes to compactness of the modified apparatus in that it embodies the working memory 56, the control circuit 59 and the read-only memory 58 for differential signals. The program which is stored in the processor 55 and the differential functions which are stored in the processor 55 render it possible to produce the first as well as the second functions. The memory 56 can be used for storage of digital tone signal amplitude values. By changing the program, one can obtain different addressing functions. The combining of analog-digital and digital-analog transducers into a single circuit (54 of FIG. 2) also contributes to simplification of the apparatus.

The provision of the feedback connection 25 renders it possible to achieve celeste effects with very high resonance frequencies, especially when the intervals of delay are short or very short.

The provision of a memory with 512 storing locations has been found to be amply sufficient for the purposes of the present invention. A memory with 512 storing locations renders it possible to break down each tone signal $S_1$ into a large number of sections.

The address ring counter 38 is preferably operated at a frequency (such as the frequency of 30 kHz shown in FIG. 1) which is only slightly above the lower limit of audio frequency. This is desirable on several grounds. Thus, such frequency cannot be discerned in the processed tone signal $S_2$. Furthermore, such frequency allows for ample time to perform several control steps within a single pulse.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for processing tone signals which are to be transmitted with a variable delay in an electronic musical instrument, especially in an electronic organ, comprising:

(a) means for supplying tone signals;

(b) a memory having input and output means and n storage locations;

(c) first transducer means for converting the amplitude of each supplied tone signal into digital values and for transmitting such values to said memory, said first transducer means being connected with said input means;

(d) addressing means including means for repeatedly counting to n, and means for effecting cyclical memorization of the digital values at locations which are selected in accordance with a first function, said effecting means comprising means for generating said first function, and said addressing means further including means for recovering digital values from said locations in accordance with at least one second function which differs from said first function in dependence on time, said recovering means comprising means for generating said second function, and said second function generating means including means for deriving said second function from said first function, said second function generating means also including means for generating an analog function, and transducer means for converting said analog function into a digital function; and (e) additional transducer means for converting the digital values recovered by said recovering means into analog values and for consolidating such analog values into processed tone signals, said additional transducer means being connected with said output means.

2. The apparatus of claim 1, further comprising selector means for adjusting said second function generating means so that the latter can furnish a plurality of different second functions.

3. The apparatus of claim 1, further comprising means for varying the amplitude of said second function.

4. The apparatus of claim 1, further comprising means for varying the frequency of said second function.

5. The apparatus of claim 1, wherein said means for generating said second function comprises means for subtracting from said first function at least one differential function.

6. The apparatus of claim 5, further comprising means for varying the amplitude of said differential function.

7. The apparatus of claim 5, further comprising means for varying the frequency of said differential function.

8. The apparatus of claim 1, wherein said first and additional transducer means form part of a single analog-digital digital-analog converter circuit.

9. The apparatus of claim 1, further comprising a feedback connection between the output of said additional transducer means and the input of said first transducer means.

10. The apparatus of claim 1, wherein said memory has 512 storage locations.

11. The apparatus of claim 1, wherein said addressing means is designed to permit the difference between said functions to be varied.

12. The apparatus of claim 1, wherein said addressing means is designed to restrict each digital signal to a single one of said locations.

13. The apparatus of claim 1, wherein said addressing means is designed to operate in cycles and both said assigning means and said recovering means are activated during each cycle.

14. Apparatus for processing tone signals which are to be transmitted with a variable delay in an electronic musical instrument, especially in an electronic organ, comprising:

(a) means for supplying tone signals;

(b) a memory having input and output means and n storage locations;

(c) first transducer means for converting the amplitude of each supplied tone signal into digital values and for transmitting such values to said memory, said first transducer means being connected with said input means;

(d) addressing means including means for repeatedly counting to n, said counting means comprising a first ring counter having an output, and timing pulse generator means connected with said first ring counter, and said addressing means further including means for effecting cyclical memorization of the digital values at locations which are selected in accordance with a first function, said effecting means comprising means for generating said first function, and said first function generating means comprising a second ring counter connected with said output of said first ring counter, said addressing means also including means for recovering digital values from said locations in accordance with at least one second function which differs from said first function in dependence on time, and said recovering means comprising means for generating said second function, said second function generating means including a function generator, and means for deriving said second function from said first function, and said deriving means comprising subtracting circuit means receiving signals from said function generator, said circuit means also receiving signals from said first ring counter by way of said first function generating means, and said first ring counter being designed to furnish signals for memorization and recovery of the digital values in accordance with said first and second functions; and (e) second transducer means for converting the digital values ascertained by said recovering means into analog values and for consolidating such analog values into processed tone signals, said second transducer means being connected with said output means.

15. The apparatus of claim 14, wherein said second ring counter is operable at a frequency which is above the lower limit of audio frequency.

16. The apparatus of claim 15, wherein said frequency is in the range of 30 kHz.

* * * * *